US006557200B1

(12) United States Patent
Mercalli

(10) Patent No.: US 6,557,200 B1
(45) Date of Patent: May 6, 2003

(54) AUTOMATIC SHOE EDGE PROCESSING MACHINE

(75) Inventor: Luciano Mercalli, Vigevano (IT)

(73) Assignee: Officini Meccaniche Cerim S.p.A., Milan (IT)

( * ) Notice: Subject to any disclaimer, the term of this patent is extended or adjusted under 35 U.S.C. 154(b) by 0 days.

(21) Appl. No.: 09/889,246

(22) PCT Filed: Nov. 16, 2000

(86) PCT No.: PCT/EP00/11555

§ 371 (c)(1),
(2), (4) Date: Jul. 11, 2001

(87) PCT Pub. No.: WO01/45527

PCT Pub. Date: Jun. 28, 2001

(30) Foreign Application Priority Data

Nov. 16, 1999 (IT) ..... MI99A2385

(51) Int. Cl.[7] ..... A43D 27/00

(52) U.S. Cl. ..... 12/86.65; 12/86.5; 12/86.6; 12/17.2; 12/33.6

(58) Field of Search ..... 12/86, 86.5, 86.6, 12/86.65, 87, 88, 90, 17.2, 33.6, 77, 123, 125

(56) References Cited

U.S. PATENT DOCUMENTS

| | | | | |
|---|---|---|---|---|
| 3,235,893 A | * | 2/1966 | Alderman et al. | 12/87 |
| 3,397,415 A | * | 8/1968 | Hans-Otto Keller | 12/86.65 |
| 3,421,166 A | * | 1/1969 | Winig | 12/33.6 |
| 5,136,745 A | * | 8/1992 | Davies et al. | 12/123 |
| 5,309,589 A | * | 5/1994 | Ferrari et al. | 12/77 |

FOREIGN PATENT DOCUMENTS

| | | |
|---|---|---|
| EP | 0210824 | 2/1987 |
| EP | 0388674 | 9/1990 |

* cited by examiner

*Primary Examiner*—Ted Kavanaugh
(74) *Attorney, Agent, or Firm*—Robert W. J. Usher

(57) ABSTRACT

A shoe edge processing machine comprises means (26, 27) of gripping a shoe along an axis (31) virtually perpendicular to the shoe, shoe processing means (16), relative movement means (12, 22) for the shoe and processing means for causing these processing means (16) to travel the edge of a shoe held in the gripping means (26, 27). Advantageously the gripping axis (21) rotates to cause the entire peripheral edge of the shoe torn under the processing head. Powered jaws (42, 43) provide positioned means for the shoe to allow its correct gripping by the gripping means (26, 27).

24 Claims, 5 Drawing Sheets

AUTOMATIC SHOE EDGE PROCESSING MACHINE

Figure 1:
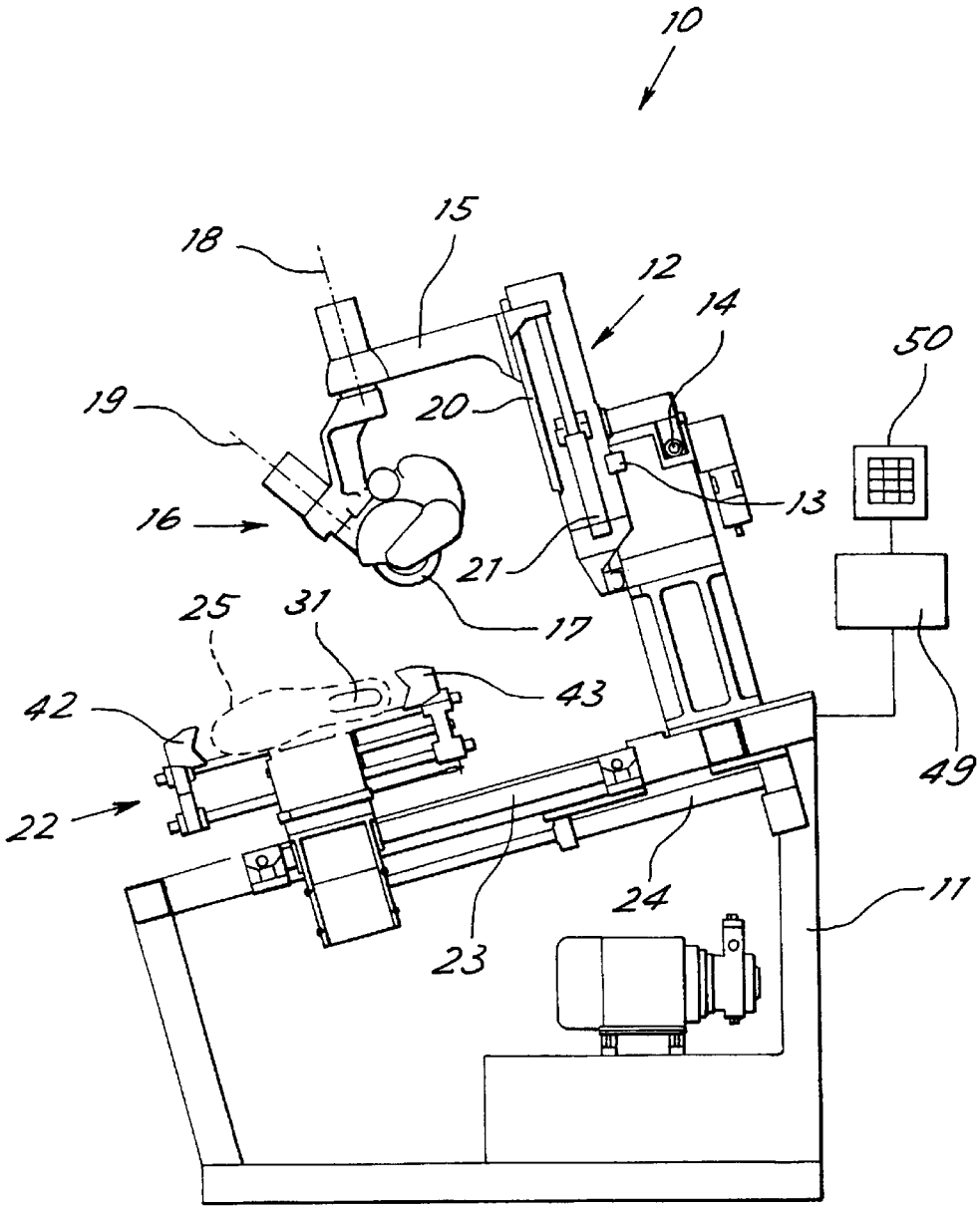

The present invention relates to an innovative automatic shoe edge processing machine.

There are ever more shoes with amply shaped soles and/or very high edge covering the outer contour of the shoe. In the prior art edge processing of such shoes e.g. for carding and spreading of the glue is still fully manual because proposals for the use of conventional processing machines designed i.e. for low-edge or unshaped shoes have proven unsatisfactory. These known machines are made for processing the shoe bottom and the shoe edge is usually processed in them only accidentally and in a slight measure when the processing tool moves near the perimeter of the bottom. Even equipping these known machines with a modified tool, edge processing remains unsatisfactory as to both quality and extension of the zone processed.

The general purpose of the present invention is to remedy the above mentioned shortcomings by making available a machine which would allow satisfactory shoe edge processing even with very high and shaped edges.

In view of this purpose it was sought to provide in accordance with the present invention a shoe edge processing machine comprising means of gripping the shoe in a direction parallel to an axis virtually perpendicular to the shoe bottom, shoe processing means and automatic movement means for the relative movement between the shoe and the processing means for causing these processing means to travel the edge of a shoe held in the gripping means.

Figure 2:
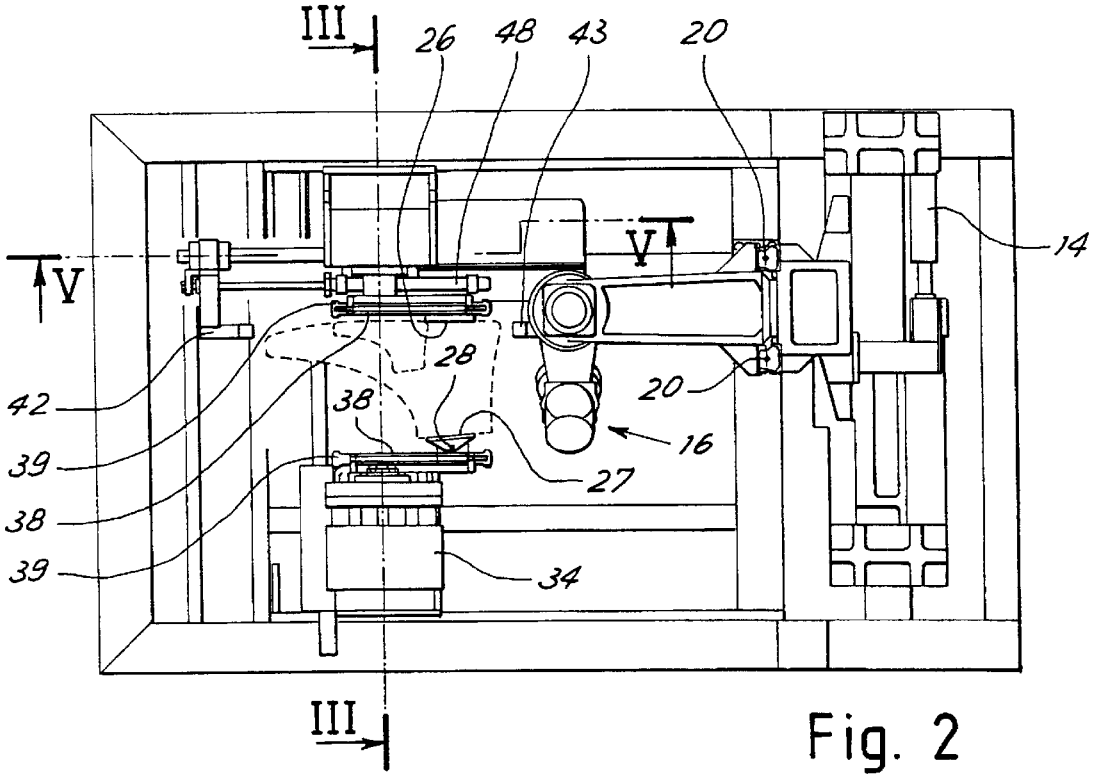
Figure 3:
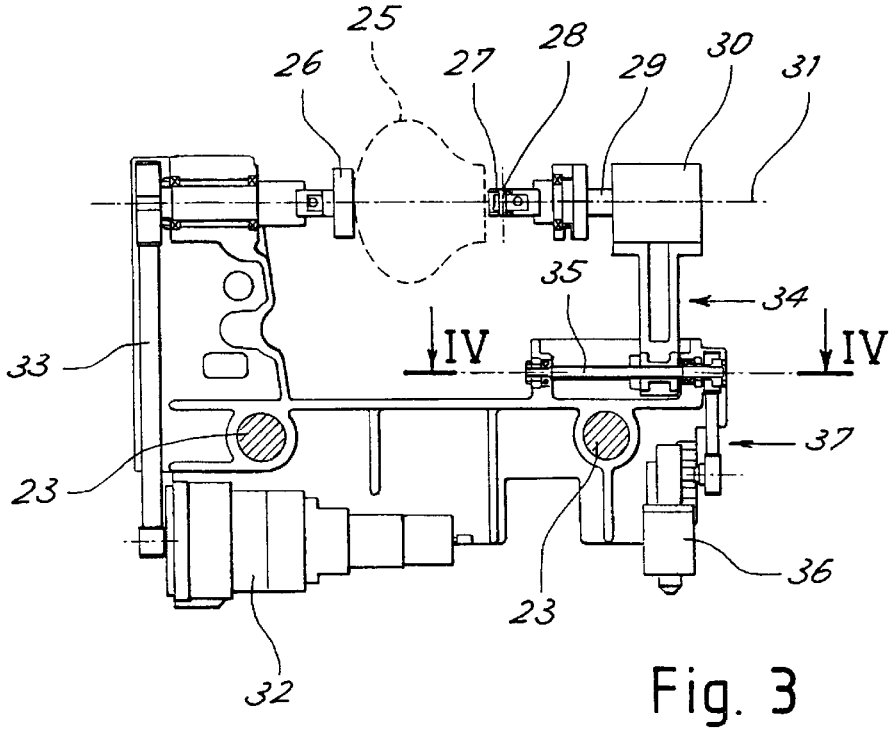
Figure 4:
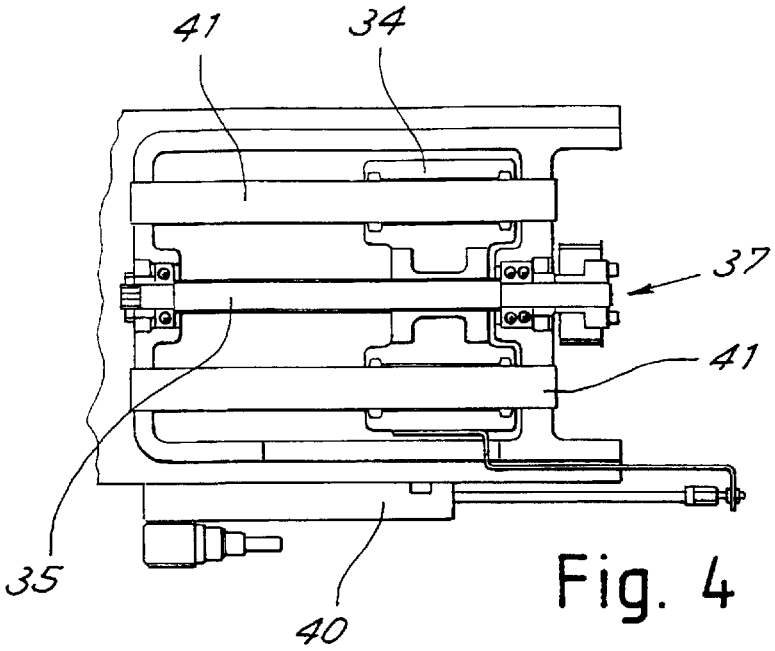
Figure 5:
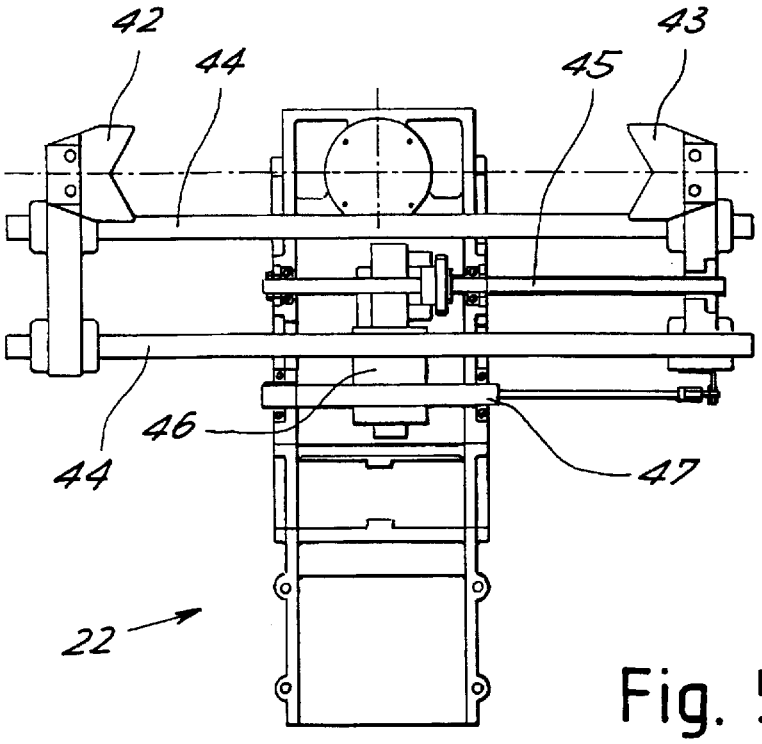
Figure 6:
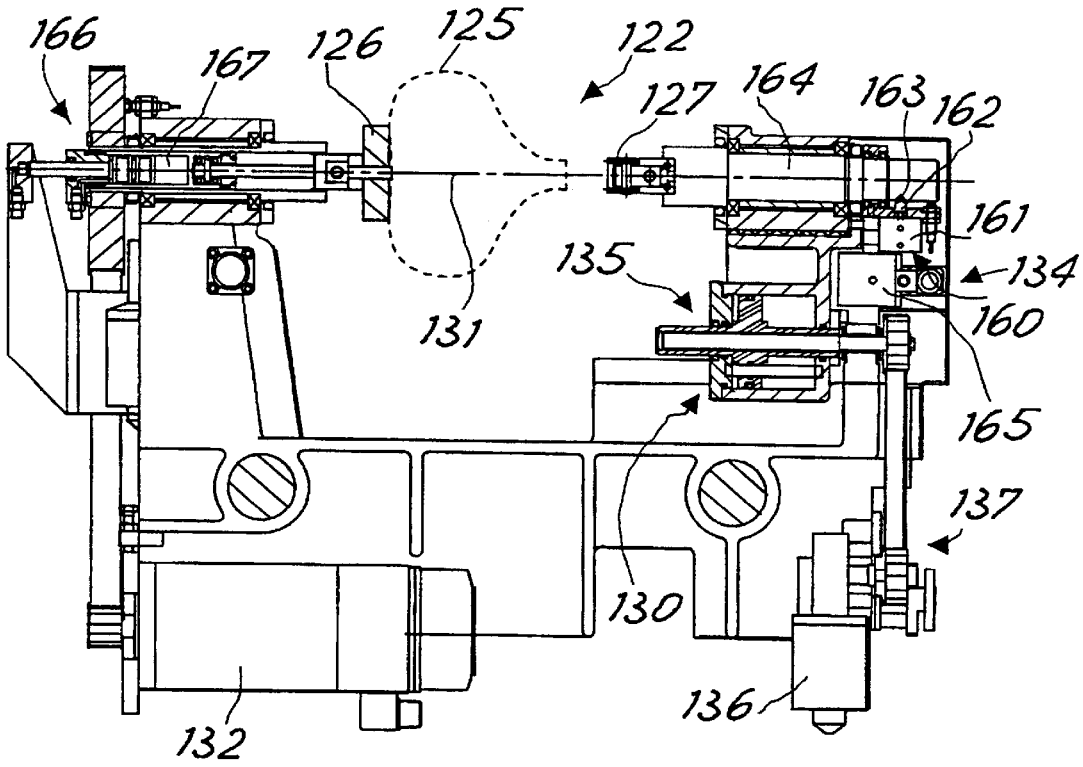
Figure 7:
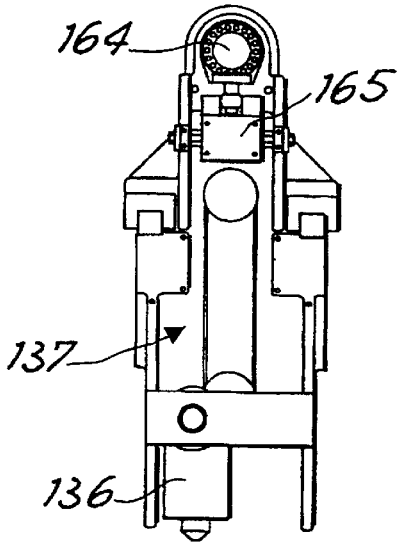
Figure 8:
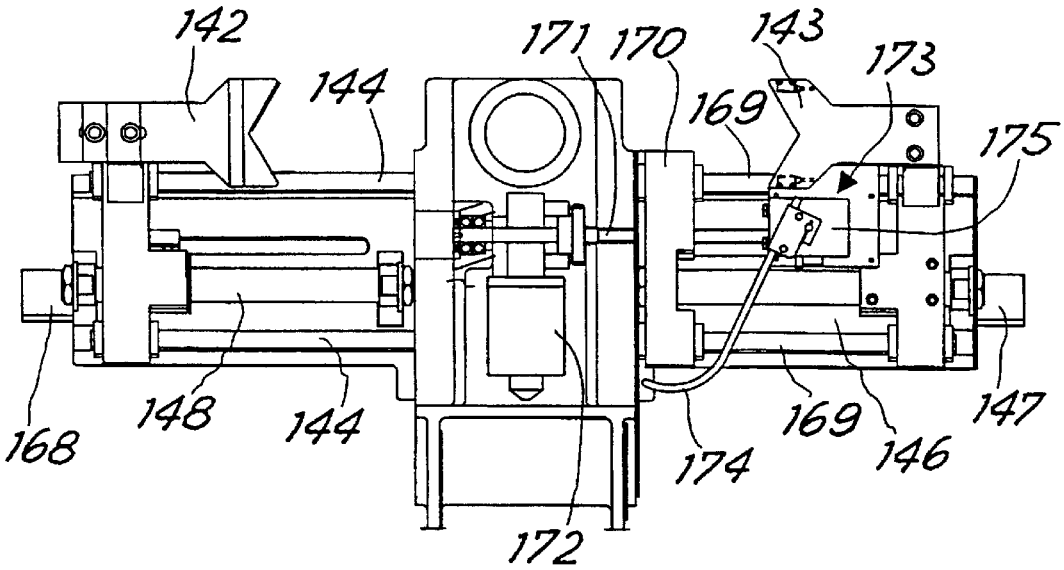
Figure 9:
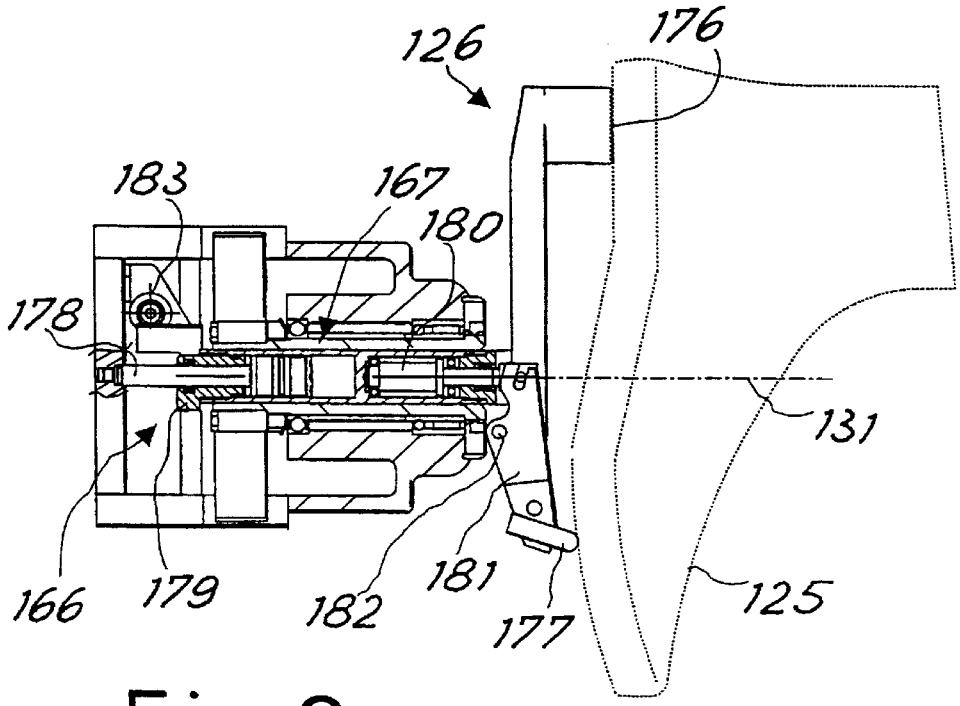

To clarify the explanation of the innovative principles of the present invention and its advantages compared with the prior art there is described below with the aid of the annexed drawings a possible embodiment thereof by way of non-limiting example applying said principles. In the drawings:

FIG. 1 shows a diagrammatic side elevation view of a machine in accordance with the present invention, FIG. 2 shows a plan view of the machine of FIG. 1, FIG. 3 shows an enlarged view of a detail of a carriage of the machine of FIG. 1 for gripping and positioning a shoe taken along plane of cut III—III of FIG. 2, FIG. 4 shows an enlarged view of the cross section IV—IV of FIG. 3, FIG. 5 shows a view of another detail of the positioning and gripping carriage taken along plane of cut V—V of FIG. 2, FIG. 6 shows a view of an alternative embodiment of the carriage of FIG. 3, FIG. 7 shows and end view of the carriage of FIG. 6, FIG. 8 shows a view of an alternative embodiment of the carriage detail shown in FIG. 5 and, FIG. 9 shows a diagrammatic cross sectioned plan view of an advantageous embodiment of a detail of the machine in accordance with the present invention.

With reference to the figures and as may be seen well in FIGS. 1 and 2 a machine in accordance with the present invention and designated as a whole by reference number 10 comprises a bed 11 on which a first carriage 12 runs along transverse guides 13 by means of an actuator 14. The carriage 12 supports a projecting arm 15 supporting in turn the processing head 16. The figure shows a carding head with rotating carding tool 17. A virtually prior art gluing head, a brushing head, a varnishing head or in general a finishing head can be readily imagined by one skilled in the art.

The processing head has movement means to provide controlled movements into the desired position in the space with respect to the surfaces to be processed. For example it has been found advantageous to supply the head with two powered rotation axes of which one is vertical 18 and one inclined 19 and which meet at the tool's processing point. The arm 15 can also move vertically along guides 20 on the carriage 12. This vertical movement is controlled by an actuator 21.

Under the processing head 16 are gripping and movement means for a shoe 25 along an axis virtually perpendicular to the shoe bottom. In particular these means comprise another carriage 22 for support of the shoe 25 to be processed. The carriage 22 runs by means of an actuator 24 along guides 23 arranged transversely to the movement of the carriage 12. Advantageously the guides 23 are arranged inclined towards the front of the machine (left in FIG. 1) to allow easier access by the operator who installs on and removes from the machine the shoes to be processed. The movement of the carriage 22 along the guides 23 has an extension such as to allow the processing head 16 to run at least the entire length of a shoe installed on the carriage 22. In addition, for safety reasons also, it is preferable that the length of the guides 23 be such that the carriage 22 can move into an advanced position (shown in FIG. 1) such as to be readily loadable and unloadable by the operator without interference with the overlying processing head. As may be seen well in FIGS. 1 and 2 the carriage 22 is designed to receive and retain the shoe in a position reclining on one side so as to present the other side to the processing head 16. The shoe has its length arranged parallel to the guides 23.

As seen in FIG. 1 it is advantageous that the processing head have a rotating tool with rotation axis virtually parallel to the shoe gripping axis and in particular that the rotating tool have its work axis, i.e. the axis along which it draws near the surface to be processed, directed virtually perpendicular to the gripping axis.

As may be seen in FIGS. 2 and 3 the stop device for the shoe on the carriage 22 comprises a pair of facing holding members 26, 27. The member 26 is made in the shape of a plate to rest on the bottom of the shoe at the heel zone. The member 27 is made in the shape of a swinging plate designed to rest on the instep of the form and is pivoted at 28 to be adaptable to the inclination of the supporting point. The plate 27 is supported on the stem 29 of a cylinder 30 to be thrustable strongly against the shoe to hold it clamped between the plates 26, 27. Both plates rotate freely around the common axis 31. The plate 27 rotates freely while the plate 26 has its rotation axis connected to a motor 32 by means of a belt transmission 33. To be adaptable to the height of different shoes the unit made up of the plate 27 and the cylinder 30 is supported on a carriage 34 moving parallel to the axis 31 by means of a screw & nutscrew coupling 35 operated by a motor 36 by means of a belt transmission 37. This can also be seen in FIG. 4 where a sensor 40 for detection of the exact position of the carriage 34 along its guides 41 is also shown.

As seen in FIG. 2 the plates 26 and 27 advantageously run along the extension of the shoe by means of screws 38 and handling wheels 39 to allow manual adjustment of their position depending on the shoe size.

As may be seen well in FIGS. 1 and 2 and in enlarged form in FIG. 5 there is advantageously a positioning and centering device on the carriage 22 also. This device comprises a pair of facing jaws 42, 43 moving towards each other in the direction of the shoe axis to grip it between the heel and the tip. As may be seen well in FIG. 5 the jaws have a generally V shape in the plane of the shoe to facilitate holding it on the shoe and allow accurate centering. The jaws are supported on a pair of guides 44 parallel to the length of the shoe. The front jaw 42 runs along the guides by means of an actuator 48 (FIG. 2) while the jaw 43 is powered by means of a screw & nutscrew coupling 45 controlled by a motor 46. A sensor 47 measures the exact position of the jaw 43 which acts as a position reference as clarified below.

Operation of the entire machine is controlled by a control unit 49 e.g. an appropriately programmed microcontroller unit known in itself and therefore not further shown nor described. Commands can be delivered by means of a keyboard 50.

FIG. 6 shows a variant embodiment of the carriage 22. For the sake of convenience parts similar to those of the carriage of FIG. 3 are designated by the same reference numbers increased by 100. There is thus a carriage 122 with a facing pair of gripping or holding members 126, 127 for gripping a shoe 125 along the axis 131 virtually perpendicular to the shoe bottom. The member 127 is supported in a rotating manner on a carriage 134 running parallel to the axis 131.

The position adaptation movement of the carriage 134 is again achieved with a screw & nutscrew coupling 135 driven by a motor 136 through a transmission 137. In the embodiment of FIG. 6 the piston 130 for holding and release of the shoe (designated by 30 in FIG. 3) is coaxial with the screw & nutscrew coupling with the cylinder piston providing the nutscrew.

FIG. 6 also shows a holding device 160 which ensures stopping of the rotation of the plate 127 and consequently of the shoe 125 in a desired usually horizontal position for the loading and unloading operations and beginning of processing. The device 160 comprises an actuator 161 which inserts on command a holding pin 162 in a recess 163 made in a suitable position in the shaft 164 for rotation of the plate 127 around the axis 131. As it is advantageous that the angular holding position of the plate 127 be slightly different according to whether the shoe to be processed is for the right or left foot the actuator 160 issupported in such a manner as to have limited angular movement around the axis 131. This limited angular movement can be held in two different angular positions by means of a second actuator 165 as may be seen in FIG. 7 in which the carriage of FIG. 6 is seen from its right end. In FIG. 7 the actuator 165 (e.g. compressed air driven) is in a central position and it is seen that it can move on command to the right or left and consequently the plate on which the actuator 161 is mounted can rotate around the axis 131 so as to select one or two different angular positions.

FIG. 8 shows a variant embodiment of the shoe positioning and centering device shown in FIG. 5. This variant comprises a pair of facing V-shaped jaws 142, 143 moving towards each other in a direction axial to the shoe to grip it between the heel and the tip.

The front jaw 124 runs on the guides 144 driven by the actuator 148 and its final position against the shoe tip is read by a sensor 168. The rear jaw 143 runs on similar guides 169 driven by a second actuator 146.

On the guides 169 also runs a reference member 170 driven by a screw & nutscrew coupling 171 powered by a motor 172. The position of the reference member 170 is read by a sensor 147. The member 170 acts as a mechanical stop for the jaw 143 whose actuator can be a mere ON/OFF piston (double action or with spring return).

In this manner the front jaw 142 and the stop 170 can be positioned accurately for the model and size of the shoe to be processed. Then the shoe centering entered each time in the machine can be performed merely by operating the actuator of the jaw 143 to push it against the stop 170.

As accurate movement of the front jaw and the stop 170 is performed only when the shoe model or size are changed there is high machine operating speed.

As shown again in FIG. 8 the machine can also comprise a device 173 for automatically detecting whether the shoe being processed is for the right or left foot so as to set the automatic drive means (12, 22, 49, 122) accordingly to adapt the tool trajectory.

The device 173 comprises a feeler made up of a shaped rod 174 driven by an actuator 175 with a position sensor. Once the shoe is positioned on the machine the actuator 175 drives the rod 174 in the direction of the arrow of FIG. 8 so as to place the rod tip against the shoe edge. The rod is sized to touch the shoe in its median zone where there is or is not a recess according to whether the shoe is for the right or left foot. From the angular position reached by the rod it is possible to determine whether the shoe mounted is for the right or left foot.

FIG. 9 shows a partial cross-section of an advantageous embodiment of holding member 126. As may be seen in this FIG seen from above with respect to FIG. 6 the holding member is made up of a first bearing member 176 and a second bearing member 177 designed to rest respectively on the heel zone and the sole zone of the shoe 125 to be processed.

The bearing member 176 is supported by and integrated with the powered part which rotates around the axis 131. The cylinder of the linear actuator 167 has its stem 178 fixed and its body 179 bearing the pin 180 in such a manner as to rotate freely around the axis. To the head of the pin 180 is hooked a lever 181 with its fulcrum at 182 and bearing at its free end the bearing member 177. Operating the actuator 167 moves the rest 176 and simultaneously rotates the lever 181 to move the rest 177 in the opposite direction to take it into a position determined by the heel height. This was found advantageous for accurate and steady positioning of the shoe during processing.

The extent of the movements controlled by the actuator 167 can be taken accurately by a sensor 183 connected by a rack to the cylinder 179.

In use, using the keyboard 50 the operator enters the shoe number to be processed or alternatively the shoe number can be read automatically in accordance with known techniques. The control unit commands the machine to ensure that the shoe is positioned in the correct position with respect to the gripping axis. Typically this will be in a mean position or with the form instep opposite the axis 31 perpendicular to the shoe. For this purpose the control unit moves the jaws and the various carriages and members to adapt the holding device to the shoe size and model. These settings can be performed only once at the beginning of processing and remain unchanged until the shoe model or number is changed.

The operator then positions the shoe on the carriage 22, 122 between the jaws 42, 43 or 142, 143 by resting it with the rear part against the reference jaw and operates the machine operation cycle. The jaw 142 (or 143) moves towards the shoe holding position so that joint action of the two jaws 42, 43 or 142, 143 centers the shoe both transversely and longitudinally.

Then the cylinder 30, 130 is operated to push the swinging plate 27, 127 against the form instep plane so as to clamp the shoe between the plates 26 and 27 or 126, 127. After clamping, the two jaws 42, 43 or 142, 143 back off to move into a rest position far from the shoe.

The carriage 22, 122 backs until it takes the shoe under the processing head 16 and the latter descends to move the tool 17 into contact with the edge to be processed.

The starting point of the processing can be a point on the side near the beginning of the heel seat. After positioning the shoe and the tool the carriage 22, 122 moves to the rear part (away from the operator) to process a side until the center of the arch with which the tip can be assimilated moves onto the tool axis. Now the motor 32, 132 is operated so that the shoe begins to rotate around the axis 31, 131 to take the shoe tip upward.

Simultaneously the carriage 22, 122 advances towards the operator. The two movements are synchronized in such a manner that the tip center moves along a segment perpendicular to the carriage running plane and coinciding with the tool working axis. After completing 180° the rotation stops and the carriage 22, 122 which in the meantime has returned to its starting position, advances again until the center of the arch with which the heel seat can be assimilated moves onto the axis of the tool.

The shoe now rotates by 180° again to raise the shoe while the carriage 22, 122 returns towards the operator again with a movement such that the heel seat arch center moves along a segment perpendicular to the carriage running plane and coinciding with the tool working axis. After the 180° rotation the carriage 22, 122 backs further until it takes the point of departure under the tool 17.

In this manner the entire 360 degrees of the edge of the shoe are traveled by the tool.

The cycle is now finished and the machine can be unloaded and reloaded with another shoe to be processed.

Of course during rotation of the shoe appropriate operation of the carriage 12 and the other tool positioning operations allows following any edge configuration and direction.

Programming the paths can be done from point to point during a previous self-learning stage before normal machine operation. The control system 49 then controls the five (or six) axes of the machine automatically in such a manner as to synchronize the movements and automatically prepare the pattern of movement of the carriage 22, 122 during rotation of the shoe depending on the size of the shoe in such a manner as to always keep the desired point (the center of the arch of the tip and/or heel seat) on one segment perpendicular to the running plane of the carriage 22, 122 whose extension passes through the tool contact point on the shoe.

If the right or left foot shoe detection device 173 is used it is operated before the beginning of shoe processing to adapt the trajectory of the tool path on the shoe accordingly. In addition the detection sensors of the mutual positions of the centering jaws can supply a signal confirming the size of the shoe mounted in the machine. Naturally the above description of an embodiment applying the innovative principles of the present invention is given by way of non-limiting example of said principles within the scope of the exclusive right claimed here.

For example as mentioned above the tool can be different from that shown in the figures, depending on the processing it is desired to perform.

What is claimed is:

1. Shoe edge processing machine comprising a shoe gripping device (26,27,126,127) for gripping a shoe in a direction parallel to an axis (31,131) virtually perpendicular to a shoe bottom, means (16) for processing the shoe and means (12,22,49,122) for producing relative movement between the shoe and the means (16) for processing the shoe for causing the means(16) for processing a shoe to travel an edge of a shoe held in the shoe gripping device (26,27,126, 127), the shoe gripping device comprising a pair of gripping members(26,27,126,127) powered for relative movement towards each other to clamp the shoe between them with a first member (26,126) of the pair being designed to rest on the bottom of the shoe and the other member of the pair being designed to rest on a leading end of an instep of a form on which the shoe to be processed is mounted, the shoe gripping device also comprising a pair of facing jaws (42,43,142,143) powered to be mutually movable towards each other in a direction transverse to the direction of movement of the pair of gripping members (26,27,126,127) to grip the shoe in a longitudinal direction on command and position the shoe for gripping by the pair of gripping members (26,27,126,127).

2. Machine in accordance with claim 1 characterized in that the shoe gripping device is mounted on a first carriage powered to be movable in a direction parallel to the longitudinal extension of the shoe and the means for processing the shoe comprise a processing head (16) supported on a second powered carriage (12) movable in a direction transverse to the shoe.

3. Machine in accordance with claim 2 characterized in that the processing head is powered to rotate along a pair of axes (18,19) which meet near one processing end (17) of said head.

4. Machine in accordance with claim 2 characterized in that the gripping axis (31,131) is arranged virtually horizontal and parallel to the direction of movement of said second carriage (12).

5. Machine in accordance with claim 4 characterized in that it comprises a control unit (49) for synchronization of movement of the carriage (22,122) with rotation of the shoe gripping device (26,27,126,127) around the gripping axis (31,131) to keep a point near the center of the arch of the tip and/or heel seat of the shoe being processed again on a segment perpendicular to the running plane of the carriage (22,122) and whose extension passes through a contact point of the processing tool on the shoe edge.

6. Machine in accordance with claim 1 characterized in that the at least one member of the pair is powered to rotate around the gripping axis (31,131) of the shoe in such a manner as to turn the entire shoe edge perimeter to be processed towards the means for processing the shoe, on command.

7. Machine in accordance with claim 6 characterized in that it comprises a holding member (160) which can be operated to hold in at least one predetermined angular position around the axis (31,131) at least one of said gripping members (26,27,126,127).

8. Machine in accordance with claim 7 characterized in that the holding member (160) moves on command to select one of two different angular positions.

9. Machine in accordance with claim 1, characterized in that the jaws of the pair have a V configuration for transverse centering of the shoe therein.

10. Machine in accordance with claim 1, characterized in that a first jaw (43, 142) of the pair is powered in a controlled manner in a position to be positionable in a predetermined reference position and the other jaw (42,143) of the pair is powered to hold the shoe against said first jaw (43,142).

11. Machine in accordance with claim 10 characterized in that it comprises a holding member (170) against which the movement of the powered jaw (143) stops during tightening of the shoe between the jaws with said holding member (170) being in turn powered for its accurate positioning on command in a position determined to correspond to the tightening position of said powered jaw.

12. Machine in accordance with claim 1 characterized in that one (27,127) of the pair of said members (26,27,126, 127) is powered to move in a controlled manner in a position to be positionable at a predetermined distance from the other member of the pair and comprises an actuator (30,130) for thrusting it towards the other member of the pair.

13. Machine in accordance with claim 1 characterized in that the processing head (16) is chosen from among a carding head, a gluing head and a brushing head.

14. Machine in accordance with claim 13 characterized in that the processing head has a rotating tool with rotation axis virtually parallel to said shoe gripping axis.

15. Machine in accordance with claim 13 characterized in that the processing head has a rotating tool with direct working axis virtually perpendicular to the gripping axis.

16. Machine in accordance with claim 1 characterized in that the gripping member (126) designed to rest on the bottom of the shoe is powered for its accurate positioning on command along a direction parallel to said axis (31,131) virtually perpendicular to the shoe bottom.

17. Machine in accordance with claim 1 characterized in that it comprises a sensor (173) for recognition of the right or left foot shoe for setting the correct corresponding movement of means (12,22,49,122) for producing relative movement between the shoe and the means (16) for processing the shoe.

18. Machine in accordance with claim 17 characterized in that the sensor (173) comprises a feeler made up of a shaped rod (174) driven by an actuator (175) with a position sensor with the rod being commanded to rest on the shoe gripped in the machine in such a manner that the right or left foot shoe information is taken from the position reached by the rod and detected by the position sensor.

19. Machine in accordance with claim 1 characterized in that the member (126) designed to rest on the shoe bottom comprises a first bearing member (176) in the shoe heel zone and a second bearing member (177) in the shoe sole zone.

20. Machine in accordance with claim 19 characterized in that the bearing members (176,177) are supported kinetically to be movable on command along the gripping axis (131) with there being a corresponding movement of the bearing member in the opposite direction upon movement of the heel zone bearing member (176) in one direction.

21. Machine in accordance with claim 20 characterized in that the heel zone bearing member (176) is supported at the head of an actuator (167) for movement along the gripping axis (131) and the sole zone bearing member (177) is supported on a lever (181) connected to said actuator for simultaneous movement in the opposite direction.

22. Shoe edge processing machine comprising a shoe gripping device (26, 27,126,127) for gripping a shoe in a direction parallel to an axis (31,131) virtually perpendicular to a shoe bottom, means (16) for processing the shoe and means (12, 22,49,122) for producing relative movement between the shoe and the means (16) for processing the shoe causing said means(16) for processing the shoe to travel an edge of the shoe held in the shoe gripping device (26,27, 126,127), the shoe gripping device (26,27,126,127) comprising a pair of gripping members (26,27, 126,127) powered for relative movement towards each other to clamp the shoe between them and the shoe gripping device (26,27, 126,127) further comprising means (42,43,142,143) for gripping the shoe in a longitudinal direction on command and for positioning the shoe in a position to be gripped by the pair of gripping members (26,27,126,127).

23. Machine in accordance with claim 22, characterized in that the pair of gripping members (26,27,126,127) comprises a first member (26,126) designed to rest on the bottom of the shoe and a second member (27,127) designed to rest on the lead end of the instep of a form in which the shoe to be processed is mounted.

24. Machine in accordance with claim 22, characterized in that the means for gripping a shoe in a longitudinal direction comprises a pair of facing jaws (42,43,142, 143) powered to be mutually movable towards each other in a direction transverse to the direction of movement of the pair of gripping members (26,27,126,127).

* * * * *